United States Patent [19]

Nelson

[11] 4,080,754

[45] Mar. 28, 1978

[54] DUAL-MODE SOUND-PRODUCING TOY

[76] Inventor: Herbert L. Nelson, 3560 S. Wells, Chicago, Ill. 60609

[21] Appl. No.: 698,310

[22] Filed: Aug. 9, 1976

[51] Int. Cl.[2] ..... A63H 5/00

[52] U.S. Cl. ..... 46/228; 46/52

[58] Field of Search ..... 46/47, 51, 52, 228

[56] References Cited

U.S. PATENT DOCUMENTS

| | | | |
|---|---|---|---|
| 3,009,265 | 11/1961 | Brown | 46/52 |
| 3,325,490 | 6/1967 | Davis | 46/52 |
| 3,772,821 | 11/1973 | Madden et al. | 46/52 |

*Primary Examiner*—Louis G. Mancene
*Assistant Examiner*—Robert F. Cutting

[57] ABSTRACT

A sounding toy with a rigid body of tapered cross section in both width and thickness produces a roaring sound when swung overhead at the end of a flexible cord. The roaring sound is enhanced by the reduction in thickness toward the outer end while the thicker base provides additional mass required for whirling. An aperture-type whistle communicating between the faces of the sounding toy imparts interesting variety to the sound.

6 Claims, 3 Drawing Figures

DUAL-MODE SOUND-PRODUCING TOY

BACKGROUND OF THE INVENTION

The amusement value to children of a toy providing a string-suspended weight which might be swung in a circle has long been recognized. Various complex stabilized designs in the shape of aircraft, as in U.S. Pat. No. 1,413,454, and birds, as in U.S. Pat. No. 2,555,429, have appeared in the art. Both of the preceding have included soundmaking apparatus to enhance the amusement value of the toy. A family of sounding toys which have been made aerodynamically unstable has also been disclosed, including U.S. Pat. No. 699,978, 3,0404,474 and 3,316,671. The aerodynamic instability produced by special aerodynamic edge bevelling or aerodynamic tang causes the body of the toy to rotate rapidly about its longitudinal axis. The whirling, spinning body makes a roaring sound which amuses children.

SUMMARY OF THE INVENTION

The present invention discloses a sounding toy having two modes of operation; one mode being inherently aerodynamically unstable and creating a roaring sound when whirled; the other mode being aerodynamically stable and producing a clean whistling sound when whirled. The aerodynamic instability is created without special airfail edges.

It is an object of this invention to provide an amusing sounding toy for children.

It is a further object of the invention to provide a sounding toy with a plurality of operating modes.

Further objects of this invention will become evident upon reading the detailed description of the preferred embodiment.

DETAILED DESCRIPTION OF THE PREFERRED EMBODIMENT

Figure 1:
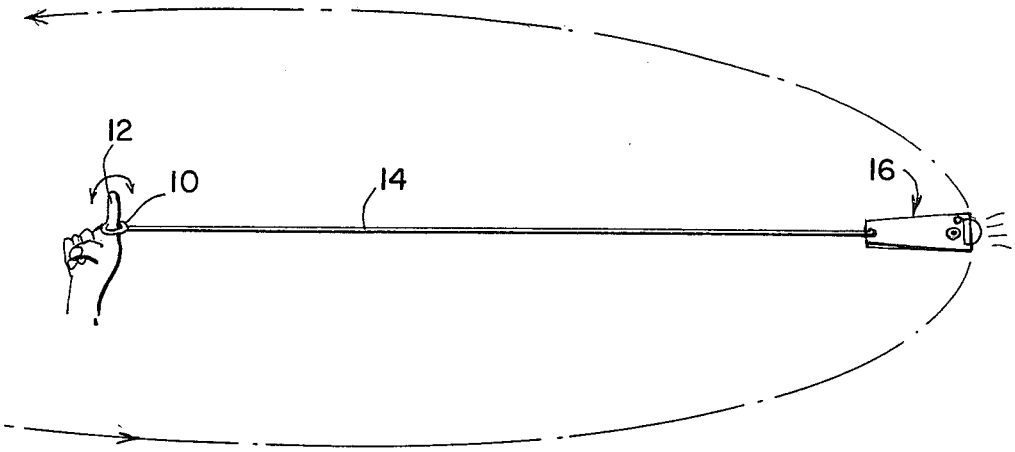
FIG. 1 shows an overall view of the sounding toy in use.

As shown in FIG. 1, a ring 10 of suitable size and material to fit very loosely over the user's finger 12 is connected by a flexible cord 14 of any suitable material to the body of the sounding toy shown generally at 16. As the sounding toy body 16 is swung in a horizontal or vertical arc at the end of the cord 14, the body 16 rotates rapidly about an axis described approximately by an extension of the cord 14. The combination of swinging and rotating motion, as the body 16 moves through the air produces a roaring sound.

Figure 2:
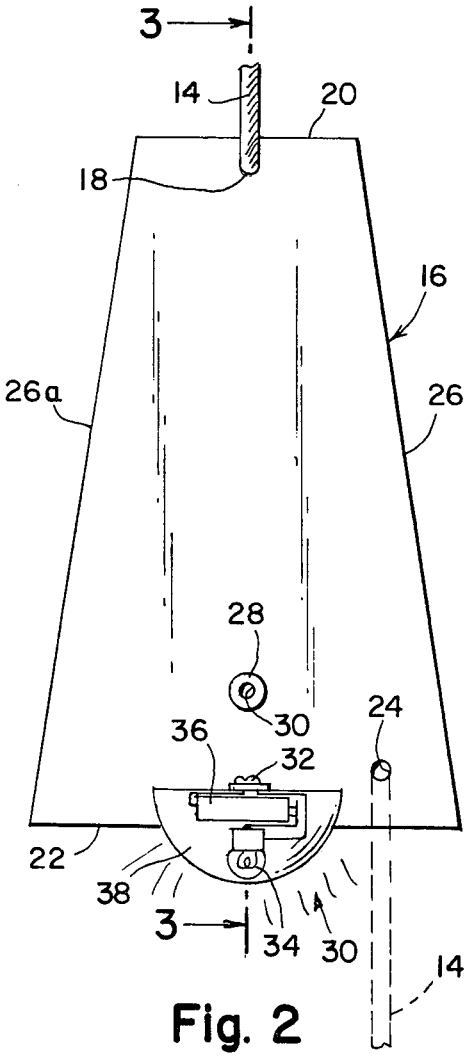
FIG. 2 shows a side view of the rigid body and cord attachment points of the sounding toy.

Referring now to FIG. 2, the sounding toy body 16 is shown suspended by the cord 14 attached in the roarer hole 18. The body 16 is in the shape of a regular trapezoid with the shorter side 20 of the two parallel sides being adjacent to the roarer hole 18. The longer side 22 of the two parallel sides located on the end remote from the roarer hole 18. The roarer hole is located on the perpendicular bisector of the longer 22 and shorter 20 sides. A whistler hole 24 is located in the body 16 adjacent to the longer side considerably closer to one of the sloping sides 26 than to the other sloping side 26*a*. The whistler hole provides an alternative suspension location for the cord 14. A whistle 28 of the plain-aperture type is located at any convenient location in the flat sides of the body. The whistle 28 has an axial aperture 30 which extends completely through the thickness of the body 16.

A lamp assembly 30, located in the center of the longer side 22 is turned on by centrifugal force acting on a switch 32. A lamp 34, powered by a battery 36, shines through a transparent cover 38 when the toy is whirled.

Figure 3:
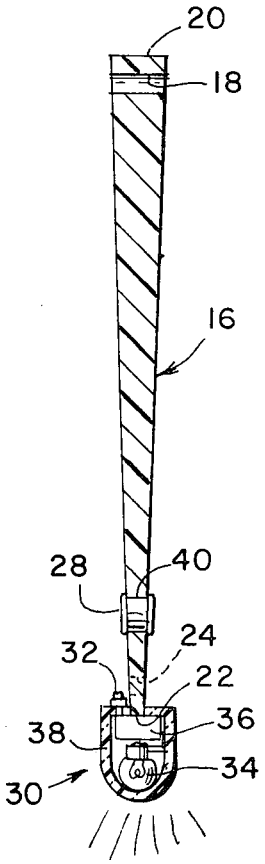
FIG. 3 shows a cross-sectional view of the rigid body of the sounding toy taken along the line 3—3 in FIG. 2.

The cross-sectional view in FIG. 3 shows that the thickness of the body tapers downward from the shorter side 20 to the longer side 22 with the thinnest material being at the longer side 22. The whistle 28 is shown mounted in a hole 40 which passes completely through from one face to the other.

For aerodynamic stability of a body moving freely through a resisting medium, the center of pressure $Cp$ must be aft of the center of gravity $Cg$. A good example of this principle is the finstabilized long thin body such as an arrow. Without the fins, the center of gravity and center of pressure of a long thin rod coincide. The rod is at best marginally stable and will tumble in its path. When fins are added, the center of pressure $Cp$ moves aft toward the fins without materially affecting the position of the center of gravity $Cg$. The requirement for aerodynamic stability, i.e., $Cp$ aft of $Cg$, is attained. A body in constrained flight, e.g. cord tethered in circular flight, the center of gravity tends to coincide with a projection of the tethering cord. If there are equal aerodynamic forces acting on the body on each side of the projection of the tethering cord, then the net force acting on the body produces a center of pressure $Cp$ which is also located along the cord. The preceding describes the conditions established when the body 16 is tethered in the roarer hole 18. The instability is increased by the fact that the outer portion, which moves at greater tangential velocity than the inner portion, has greater surface area. Thus the body 16 will spin about the projection of the cord, thereby producing an interesting roaring sound. The whistle adds an additional acoustic element to the roaring sound.

On the other hand, when tethered in the whistler hole 24, the projection of the cord 14 still passes through the center of gravity $Cg$, but more surface area exists on one side of the cord 14 than on the other. Thus, when swung, a stable aerodynamic condition will be established in which the body 14 will streamline. The roaring sound will be absent in this condition, however, the whistling sound will be clearer. In addition, due to the streamlining of the body 14, higher tangential velocities will be attainable enabling louder whistling.

What is claimed is:

1. A dual-aerodynamic-mode whirling sounding toy comprising:

a. a trapezoidal body;

b. tethering means for constraining the orbital path of said trapezoidal body;

c. attachment means in said body for said tethering means;

d. a whistle in said body operative produces a whistling sound when said body containing said whistle is moved rapidly through the air; and e. said trapezoidal body being of greater thickness near the shorter of the parallel sides than near the longer of the parallel sides of the trapezoid.

2. The sounding toy recited in claim 1, wherein said attachment means is a hole located on the perpendicular bisector of the two parallel sides of said trapezoidal body.

3. The sounding toy recited in claim 2, wherein said hole is located closer to said shorter than to the longer of the two parallel sides.

4. The sounding toy recited in claim 1, wherein said attachment means is a hole, said hole being located closer to the longer of the two parallel sides of said trapezoidal body, and also being located closer to one of the sloping sides of said trapezoidal body than to the other sloping side.

5. The sounding toy recited in claim 1, wherein said attachment means comprises:

a. a first hole located along the perpendicular bisector of the two parallel sides of said trapezoidal body, said location being decidedly closer to said shorter parallel sides; and b. a second attachment hole located closer to the longer of said parallel sides and also located closer than the other to one of the sloping sides of said trapezoidal body.

6. The sounding toy recited in claim 1, further comprising:

a. an electrical switch;

b. said switch being adapted to closure by centrifugal force;

c. a battery having one terminal connected to one terminal of said switch; and d. a lamp having first and second terminals, said first lamp terminal being connected to a second terminal of said battery, said second lamp terminal being connected to a second terminal of said switch.

* * * * *